US006033209A

United States Patent [19]

Shin et al.

[11] Patent Number: 6,033,209

[45] Date of Patent: Mar. 7, 2000

[54] MELODY CANDLE ASSEMBLY

[76] Inventors: Haeng Chul Shin, Donglimhaichu 701, 390-6, Yongho3-dong, Nam-ku; Kang Jung Park, Usung Apartment 101-1407, 57, Kaegeum3-dong, Pusanjin-ku, both of Pusan, Rep. of Korea

[21] Appl. No.: 09/265,061

[22] Filed: Mar. 9, 1999

[30] Foreign Application Priority Data

Nov. 9, 1998 [KR] Rep. of Korea ..... 98-21703

[51] Int. Cl.[7] ..... F23D 3/16

[52] U.S. Cl. ..... 431/253; 431/289

[58] Field of Search ..... 431/253, 289

[56] References Cited

U.S. PATENT DOCUMENTS

| | | | |
|---|---|---|---|
| 4,568,269 | 2/1986 | Lin | 431/253 |
| 5,015,175 | 5/1991 | Lee | 431/289 |
| 5,807,096 | 9/1998 | Shin et al. . | |

*Primary Examiner*—Carroll Dority
*Attorney, Agent, or Firm*—Dilworth & Barrese

[57] ABSTRACT

A melody candle assembly for reproducing a melody or music responding to a light signal, comprising a candle provided with at least a recess at its bottom surface and having a wick and an elongate optical fiber embedded therein, said optical fiber being extended over the lower end of the candle; a candlestick element for holding the candle with the top surface provided with a center hole to which the lower end of the optical fiber is extended and at least two apertures spaced apart around the center hole; a melody reproducing unit provided in the candlestick element for selectively reproducing at least two melodies or music. The melody reproducing unit includes a photo sensor fitted opposite the lower end of the optical fiber to sense a light signal transmitted through the optical fiber for making the unit prepared for operation and at least two melody selection switch knobs corresponding to the number of the melodies or music stored therein. The switch knobs are movably protruded over the respective apertures formed on the top surface of the candlestick element so that the switch knobs are selectively pressed down for selecting a melody or music by the candle fitted on the candlestick element with the unselected switch knob(s) received in the recess(es) at the bottom surface of the candle.

16 Claims, 4 Drawing Sheets

MELODY CANDLE ASSEMBLY

BACKGROUND OF THE INVENTION

1. Field of the Invention

The present invention relates to a melody candle assembly, and more particularly to a melody candle assembly which can be used repeatedly for reproducing a selected melody or music according to the position of a recess(es) on the bottom surface of a candle placed on a candlestick element.

2. Description of the Prior Art

The U.S. Pat. No. 5,807,096 discloses a decorative candle assembly which has a wick and an optical fiber axially embedded in a decorative candle. When the wick is ignited, the light produced is transmitted via the optical fiber to a melody reproducing unit which is provided in a candlestick on which the candle is placed. Thus, the melody reproducing unit is operated by the light signal via the optical fiber and reproduces a melody stored in its memory.

However, even after the candle is put out, the melody reproducing unit may keep operating owing to the sunlight or light from an electric lamp which is transmitted through the transparent optical fiber.

Furthermore, since the melody candle assembly can reproduce a single melody, its user is apt to be bored fast with listening to only one melody. Thus, the user should buy a plurality of the products for enjoying different pieces of melody or music. Additionally, the candle assembly can not be reused and thereby the whole assembly including the melody reproducing unit should be discarded, which means waste of money and resources.

SUMMARY OF THE INVENTION

It is an object of the present invention to provide a novel and improved melody candle assembly adapted to reproduce a piece of melody or music selected from at least two of them stored therein so that the user may choose one among several melodies or music as he wants.

Another object of the present invention is to provide a reusable melody candle assembly.

Still another object of the present invention is to provide a melody candle assembly adapted to operate without any affection of light from the sun, lamps, etc.

To achieve the above objects, according to the present invention, a melody candle assembly for reproducing a piece of melody or music selected by a user comprises a candle provided with at least a recess at its bottom surface and having a wick and an optical fiber axially embedded therein, said optical fiber being extended over the lower end of the candle; a candlestick element having a top surface for supporting the candle and provided with at least two apertures spaced apart and a center hole to which the lower end of the wick is extended; a melody reproducing unit arranged inside the candlestick element for selectively reproducing at least two melodies or music, which includes a photo sensor fitted opposite the lower end of the wick in the center hole of the candlestick element to sense a light signal transmitted through the optical fiber for making the unit prepared for operation and melody selection switch knobs corresponding to the number of the melodies or music stored therein, the switch knobs being movably held in the respective apertures formed on the top surface of the candlestick element so that one of the switch knobs is selectively pressed for melody or music selection by the bottom surface of the candle with the unselected switch knobs received in the recess(es) at the bottom surface of the candle, when the candle is put on the candlestick element.

The lower end of the candle may have a cap, the bottom surface of which is provided with at least one recess.

While the candle keeps burning, the wick and optical fiber in the candle are burnt together with the shielding material coated on or around the optical fiber. When the candle is blown out, the molten shielding material is hardened to cover the exposed end portion of the optical fiber, thereby preventing the outside light from coming into the optical fiber via the exposed end thereof. Thus, according to the present invention, the melody reproducing unit may surely stop operating when the candle is put out.

BRIEF DESCRIPTION OF THE DRAWINGS

The foregoing and other objects, features and advantages of the present invention will become more apparent from the following detailed description when taken in conjunction with the accompanying drawings in which.

DETAILED DESCRIPTION OF THE PREFERRED EMBODIMENT

Figure 1:
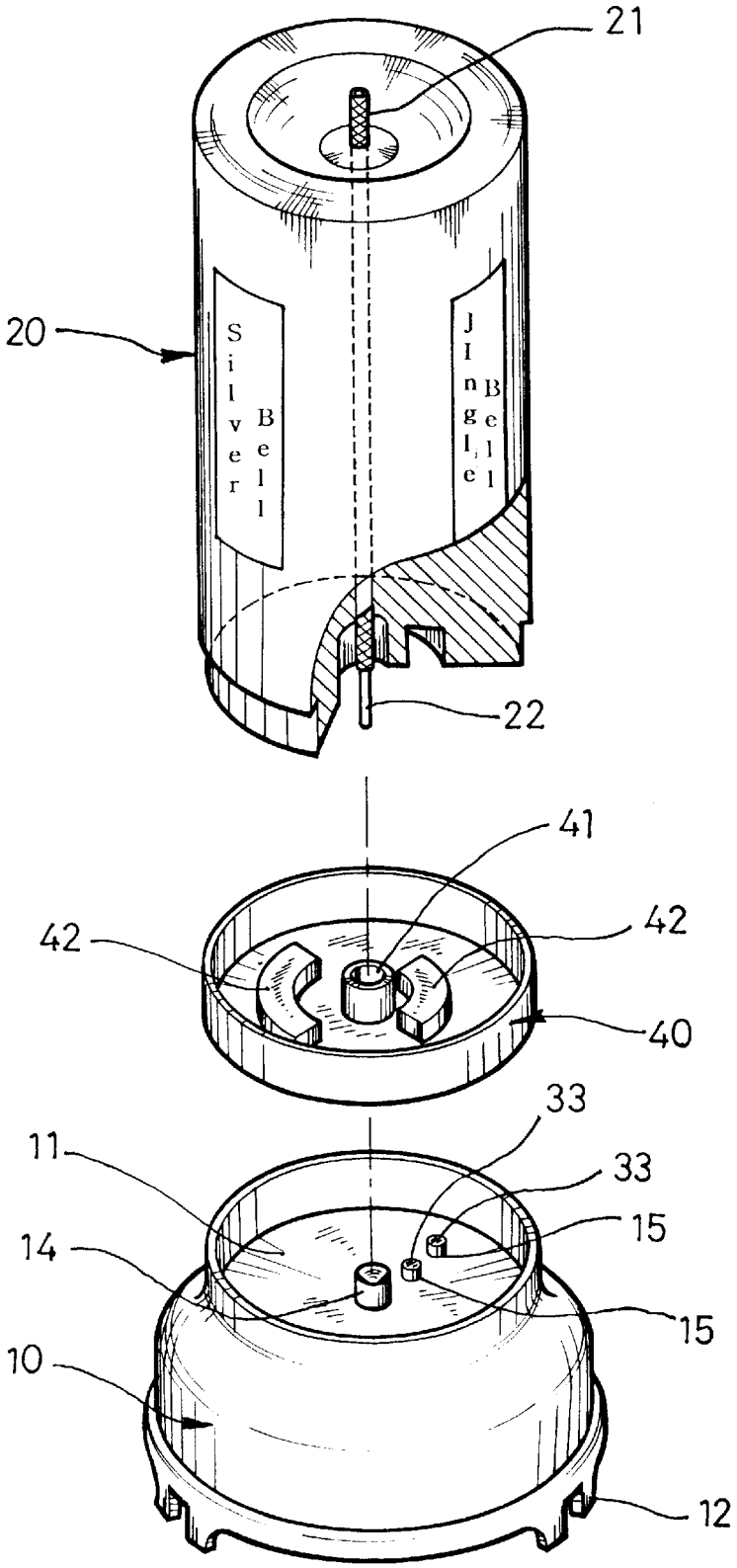
FIG. 1 is an exploded and partially cut away perspective view of a melody candle assembly according to a preferred embodiment of the present invention.
Figure 2:
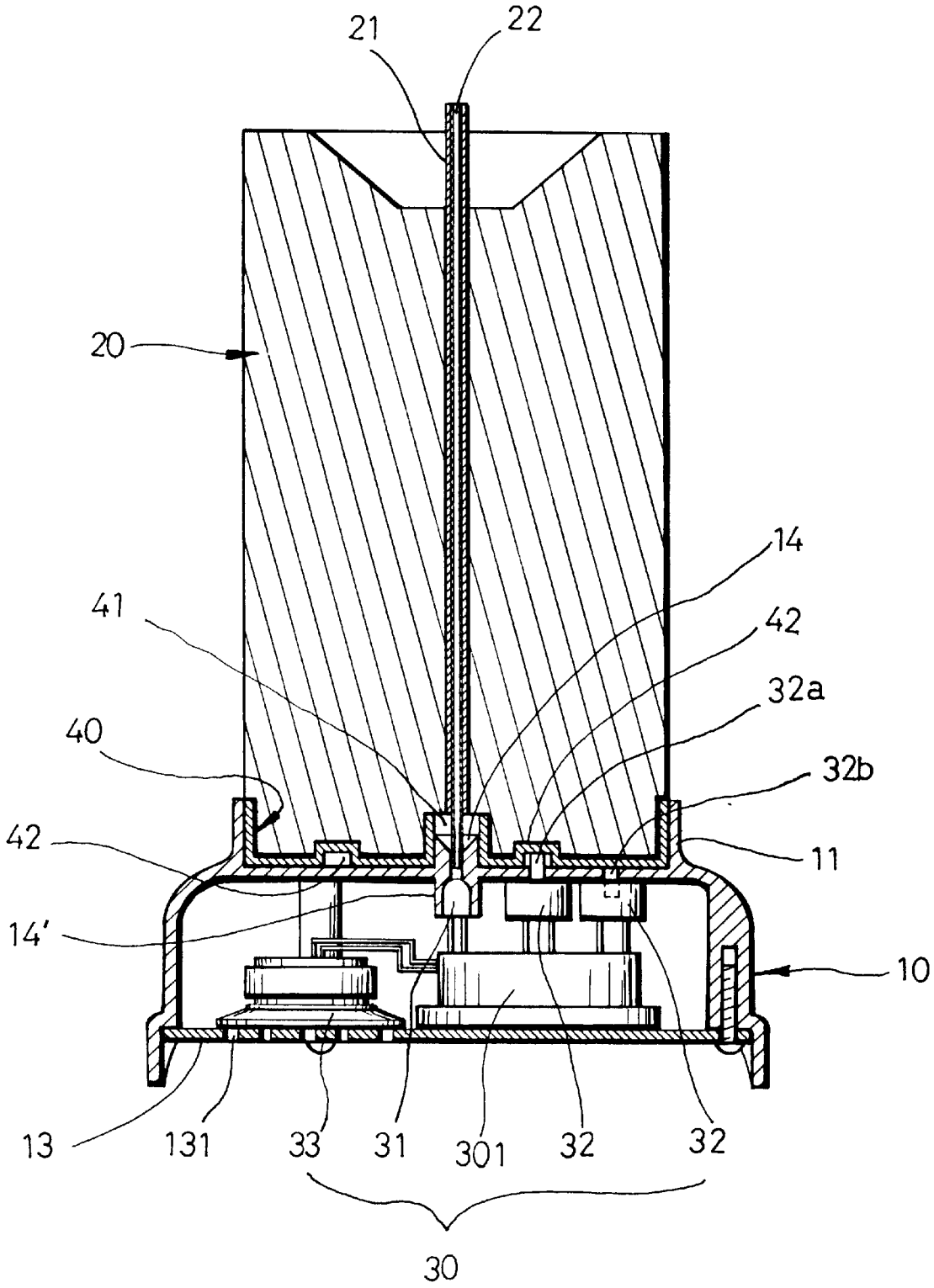
FIG. 2 is a longitudinal sectional view of the melody candle assembly in FIG. 1.

Referring to FIGS. 1 and 2, a melody candle assembly according to a preferred embodiment of the present invention comprises a candlestick 10 made of synthetic resin, ceramic or cast iron and a decorative candle 20 supported thereon.

The candle 20 includes a wick 21 and an optical fiber 22 which are axially embedded therein. The optical fiber 22 extends below the lower end of the candle 20. A cap 40 is provided at the lower end portion of the candle 20 to cover it. The cap 40 has a cylindrical protrusion with a hole 41 for allowing the lower end of the optical fiber 22 to pass through it.

The candlestick 10 has a top surface 11 shaped in a hollow to receive the cap 40 for supporting the candle 20, the top surface 11 including the upper and lower cylindrical protrusions 14 and 14' formed at its top and bottom surfaces, respectively. When the candle 20 is put on the top surface 11, the protrusion of the cap 40 is inserted into a hole in the upper protrusion 14 so that the lower end portion of the optical fiber 22 passes through a hole in the lower protrusion 14'.

At least two apertures 15 are formed on the top surface 11, which will be explained about in detail below. A plurality of legs may be further provided on the candlestick 10.

Figure 3:
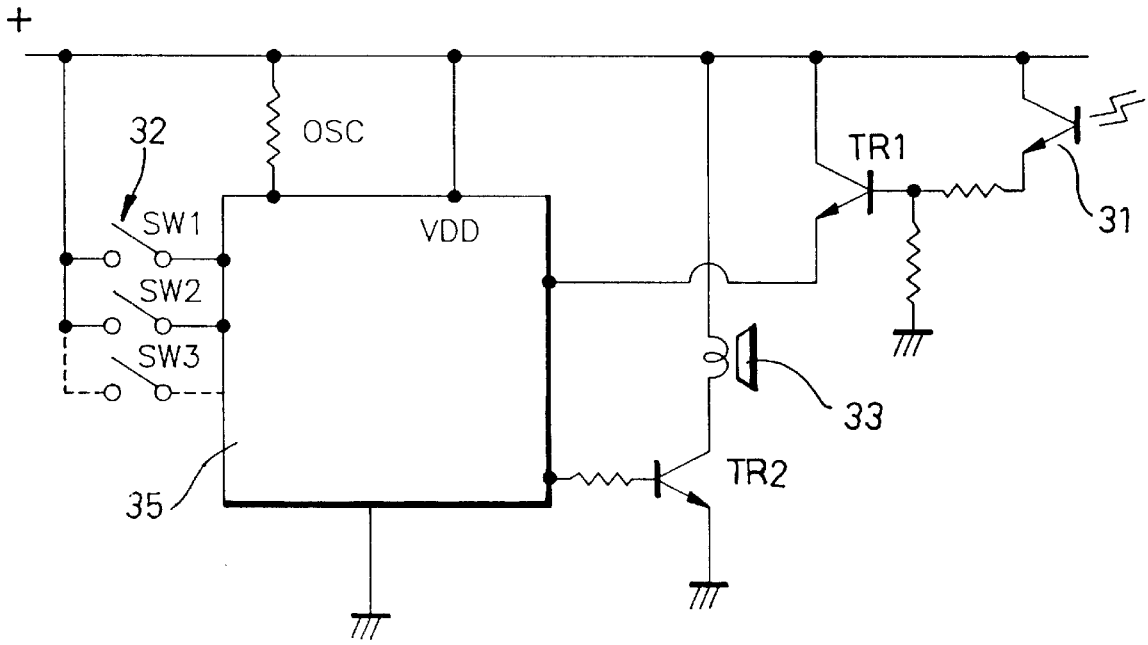
FIG. 3 is an example of an electric circuit for use in the melody candle assembly according to the present invention.

Referring to FIGS. 2 and 3, a melody reproducing unit 30 is provided in the vacant portion defined by the wall of the candlestick 10 and is adapted to be operated by the light signal transmitted through the optical fiber 22, when the candle 20 is lighted.

The melody reproducing unit 30 includes an integrated circuit (IC) 35 storing two pieces of melodies, two melody selection switches 32 corresponding to each of the melodies stored in the IC 35, a photo sensor 31 receiving the light signal transmitted through the optical fiber 22 and outputting a signal to drive a transistor TR1 so that the IC 35 is operated to reproduce the selected melody which is amplified by a transistor TR2 and a speaker 33. The melody reproducing unit 30 is mounted on a bottom plate 13 of the candlestick 10. A plurality of apertures 131 are formed on the bottom plate opposite the speaker 33.

The photo sensor 31 is fitted in the hole of the lower cylindrical protrusion 14' and is adapted to face the lower end of the optical fiber 22 extended through the hole in the upper cylindrical protrusion 14, thereby receiving a light signal therefrom when the candle 20 is lighted.

The selection switches 32 are provided with push button type knobs 32*a* and 32*b*, which are arranged to be radially spaced and movably protruded over the corresponding apertures 15 formed on the top surface of the candlestick.

Two recesses 42 are formed at the bottom surface of the cap 40 for receiving the protruded knobs for the unselected melody.

When the candle 20 is set on the top surface 11 of the candlestick 10, for example, the selection knob 32*a* for the melody desired to be reproduced is pressed down by the bottom surface of the cap 40, but another knob 32*b* is received in the corresponding recess 42.

To change the melody to be reproduced, the user may remove the candle 20 and set on the candlestick 10 again so that the bottom surface of the cap 40 of the candle 20 presses down the knob 32*b*, while the other knob 32*a* is received in the corresponding recess 42. Thus, the user can easily select a melody to be reproduced by positioning the candle 20 on the top surface 11 of the candlestick 10. For easy selection of the desired melody, the positions of the recesses 42 and/or numbers of the corresponding melodies may be indicated at the proper peripheral surface of the candle 20.

Figure 4A:
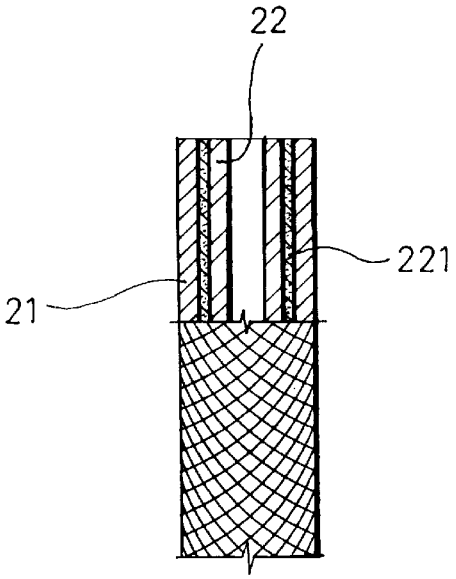
FIG. 4*a* is a partially sectional view showing a wick structure of a candle of the melody candle assembly in FIG. 1, in which an optical fiber is concentrically provided in a wick.

According to the present invention, as shown in FIG. 4*a*, the optical fiber 22 is coated with a shielding material 221 and axially embedded in the wick 21 which may be firmly bonded to candle wax. The shielding material 221 is preferably combustible and non-polluting and may be selected from, for example, colored enamel, lacquers or paints.

Figure 4B:
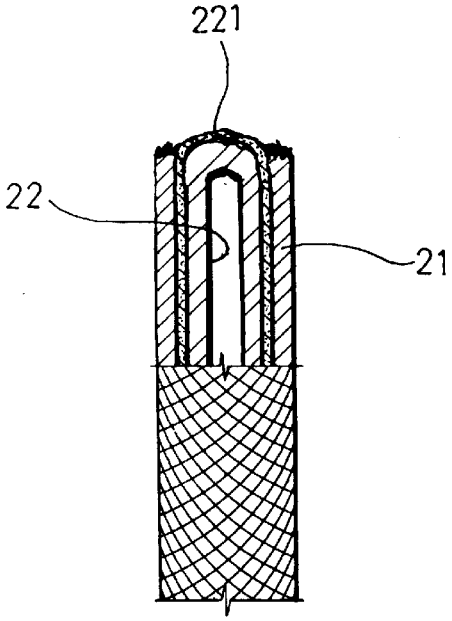
FIG. 4*b* is a view similar to that of FIG. 4*a* showing an end portion of the optical fiber covered by the hardened shielding material to shield the outside light.

While the candle keeps burning, the wick 21 and the optical fiber 22 in the candle are burnt with the shielding material 221 coated on or around the optical fiber. When the candle 20 is put out, as shown in FIG. 4*b*, the molten shielding material 221 is hardened after being mixed with the molten end portions of the wick 21 and the optical fiber 22 to shield the exposed end portion of the optical fiber 22 from the outside light such as sunlight or lamp light, thereby preventing the melody reproducing unit 30 from being operated by the outside light.

Figure 5:
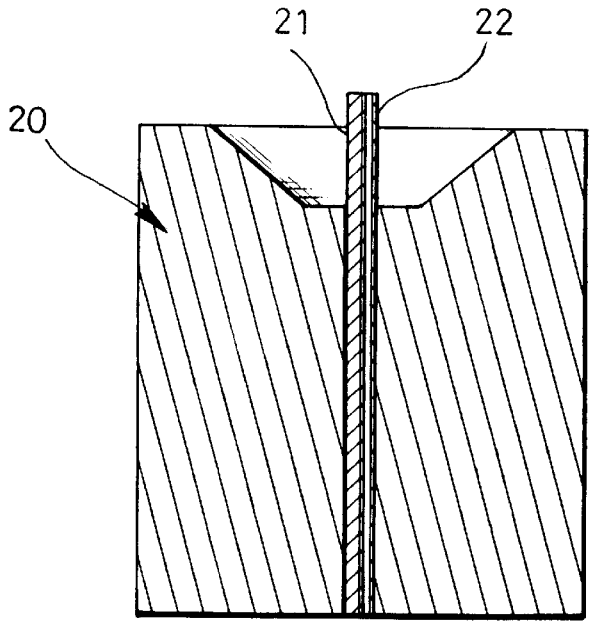
FIG. 5 is a view similar to that of FIG. 4*a* showing another wick structure in which an optical fiber is arranged in parallel with the wick.

In FIG. 5 showing another wick structure of the candle according to the present invention, the wick 21 and the optical fiber 22 coated with a shielding material may be arranged at the center of the candle in parallel with each other.

Figure 6A:
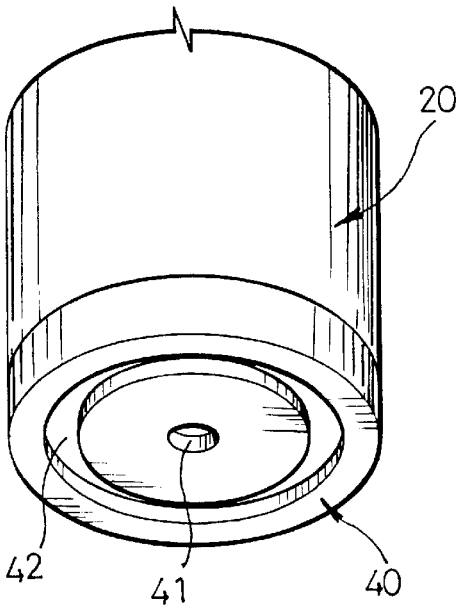
FIGS. 6*a* and 6*b* are bottom perspective views showing the modified caps provided at the lower end of a candle.
Figure 6B:
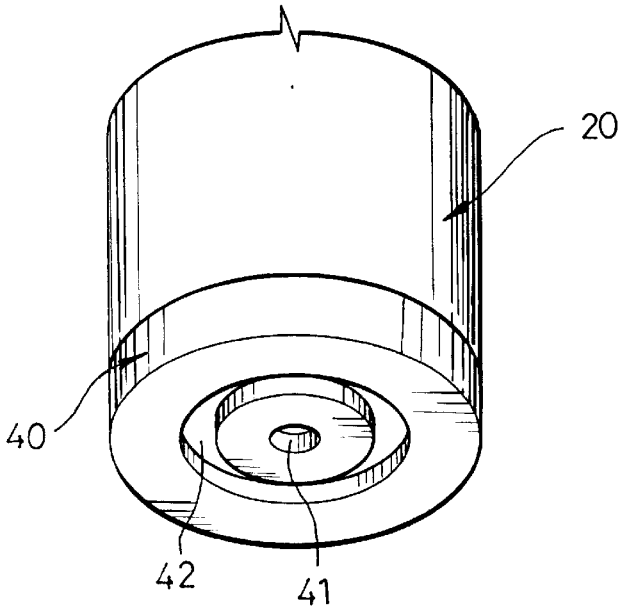

FIGS. 6*a* and 6*b* shows other examples of caps 40 for the candle 20, respectively, having a circular recess 42 in different diameters from each other so that the reproducing unit 30 may reproduce a melody selected by means of the recess 42 of the cap 40 on the candle 20.

Although it is disclosed in the embodiment described herein that the recesses for receiving the unselected switch knobs are formed on the cap of the candle, they may be directly formed in the bottom surface of the candle 20 without employing the cap 40.

The recesses may be formed apart in the same or different circumferences and it is preferable that their sizes are bigger than the knobs and they have the arcuate or circular shapes.

It should be understood that this invention is described hereinbefore with reference to the preferred embodiments, but various changes and modifications may be made according to the invention without departing from the spirit of the present invention and the scope of the appended claims.

What is claimed is:

1. A melody candle assembly for reproducing a piece of melody or music responding to a light signal, comprising;

a decorative candle provided with at least a recess on the bottom surface and having a wick and an optical fiber embedded therein, said optical fiber being extended over the lower end of the candle;

a candlestick element having a top portion for supporting the candle and provided with at least two apertures spaced apart and a center hole to which the lower end of said optical fiber is extended;

a melody reproducing unit provided in said candlestick; element for selectively reproducing at least two melodies or music, which includes a photo sensor fitted opposite the lower end of said optical fiber and melody selection switch knobs corresponding to the number of the melodies or music stored therein, the switch knobs being movably protruded over the respective apertures formed at the top portion of the candlestick element so that the switch knobs are selectively pressed down for melody or music selection by the bottom surface of the candle placed on the candlestick element with the unselected switch knobs received in the recess(es) at the bottom surface of the candle.

2. A melody candle assembly according to claim 1, wherein said optical fiber is coated with a material for shielding it from the outside light such as sunlight or light of electric lamps so that the melody reproducing unit stops reproducing a melody when the candle is put out.

3. A melody candle assembly according to claim 1, wherein said candle has a cap put on the lower end thereof and provided with at least a recess on its bottom surface.

4. A melody candle assembly according to claim 1, wherein said recess (es) has an arcuate shape.

5. A melody candle assembly according to claim 1, wherein said recess(es) has a circular shape.

6. A melody candle assembly according to claim 5, wherein there are two recesses, said recesses are formed on the same circumference.

7. A melody candle assembly according to claim 5, wherein said recess (es) is formed on the different circumferences.

8. A melody candle assembly according to claim 3, wherein said recess(es) has an arcuate shape.

9. A melody candle assembly according to claim 3, wherein said recess(es) has a circular shape.

10. A melody candle assembly according to claim 2, wherein said candle has a cap put on the lower end thereof and provided with at least a recess on its bottom surface.

11. A melody candle assembly according to claim 2, wherein said recess(es) has an arcuate shape.

12. A melody candle assembly according to claim 2, wherein said recess(es) has a circular shape.

13. A melody candle assembly according to claim 12, wherein said recess(es) is formed on the same circumference.

14. A melody candle assembly according to claim 12, wherein said recess(es) are formed on different circumferences.

15. A melody candle assembly according to claim 10, wherein said recess(es) has an arcuate shape.

16. A melody candle assembly according to claim 10, wherein said recess(es) has a circular shape.

* * * * *